US005962178A

United States Patent [19]

Cheng

[11] Patent Number: 5,962,178

[45] Date of Patent: Oct. 5, 1999

[54] SEDIMENT FREE TONER PROCESSES

[75] Inventor: Chieh-Min Cheng, Rochester, N.Y.

[73] Assignee: Xerox Corporation, Stamford, Conn.

[21] Appl. No.: 09/005,281

[22] Filed: Jan. 9, 1998

[51] Int. Cl.[6] ..... G03G 9/087

[52] U.S. Cl. ..... 430/137; 523/335; 430/109

[58] Field of Search ..... 430/137, 109; 523/335

[56] References Cited

U.S. PATENT DOCUMENTS

| | | | |
|---|---|---|---|
| 3,590,000 | 6/1971 | Palermiti et al. | 252/62.1 |
| 3,655,374 | 4/1972 | Palermiti et al. | 96/1.4 |
| 3,674,736 | 7/1972 | Lerman et al. | 260/41 R |
| 3,720,617 | 3/1973 | Chatterji et al. | 252/62.1 |
| 3,944,493 | 3/1976 | Jadwin et al. | 252/62.1 P |
| 3,983,045 | 9/1976 | Jugle et al. | 252/62.1 P |
| 4,007,293 | 2/1977 | Mincer et al. | 427/19 |
| 4,079,014 | 3/1978 | Burness et al. | 252/62.1 P |
| 4,137,188 | 1/1979 | Uetake et al. | 252/62.1 P |
| 4,265,990 | 5/1981 | Stolka et al. | 430/59 |
| 4,394,430 | 7/1983 | Jadwin et al. | 430/110 |
| 4,558,108 | 12/1985 | Alexandru et al. | 526/340 |
| 4,560,635 | 12/1985 | Hoffend et al. | 430/106.6 |
| 4,563,408 | 1/1986 | Lin et al. | 430/59 |
| 4,585,884 | 4/1986 | Lin et al. | 556/413 |
| 4,797,339 | 1/1989 | Maruyama et al. | 430/109 |
| 4,935,326 | 6/1990 | Creatura et al. | 430/108 |
| 4,937,166 | 6/1990 | Creatura et al. | 430/108 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,516,865 | 5/1996 | Urquiola | 526/329.7 |
| 5,527,658 | 6/1996 | Hopper et al. | 430/137 |
| 5,561,025 | 10/1996 | Torres et al. | 430/137 |
| 5,585,215 | 12/1996 | Ong et al. | 430/107 |
| 5,650,255 | 7/1997 | Ng et al. | 430/137 |
| 5,650,256 | 7/1997 | Veregin et al. | 430/137 |

*Primary Examiner*—Christopher D. Rodee
*Attorney, Agent, or Firm*—E. O. Palazzo

[57] ABSTRACT

A process for the preparation of toner including (i) aggregating a colorant and a latex emulsion containing a resin, reactive surfactant, and an ionic surfactant to form toner sized aggregates, (ii) coalescing or fusing said aggregates; and optionally (iii) isolating the toner generated, washing, and drying the toner.

16 Claims, No Drawings

SEDIMENT FREE TONER PROCESSES

PENDING APPLICATIONS AND PATENTS

Illustrated in copending applications, the disclosures of which are totally incorporated herein by reference, U.S. Ser. No. 08/960,754 pending are cleavable surfactants; U.S. Pat. No. 5,766,818 is emulsion/aggregation with cleavable surfactants; U.S. Ser. No. 08,959,798 pending is emulsion/aggregation with water miscible chain transfer agents; U.S. Pat. No. 5,766,817 is emulsion/aggregation with miniemulsion; and U.S. Pat. No. 5,853,943, filed concurrently herewith, is latex preparation with a diphenyl oxide disulfonate initiator.

BACKGROUND OF THE INVENTION

The present invention is generally directed to toner processes, and more specifically, to processes which utilize aggregation and coalescence or fusion of the latex, colorant, such as pigment, dye, or mixtures thereof, and optional additive particles. In embodiments, the present invention is directed to processes which provide toner compositions with a volume average diameter of from about 1 micron to about 20 microns, and preferably from about 2 micron to about 12 microns, and a narrow particle size distribution of, for example, about 1.10 to about 1.45, and more specifically, about 1.19 as measured by the Coulter Counter method without the need to resort to conventional toner pulverization and classification methods. The resulting toners can be selected for known electrophotographic imaging and printing processes, including digital color processes.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process can result in the formation of particles with a wide particle size distribution. Similarly, the aforementioned disadvantages, for example poor particle size distributions, are obtained hence classification is needed resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization.

In U.S. Pat. No. 5,561,025 there are illustrated emulsion/aggregation/coalescence processes wherein water phase termination agents are selected.

Other prior art that may be of interest include U.S. Pat. Nos. 3,674,736; 4,137,188 and 5,066,560.

Emulsion/aggregation processes for the preparation of toners with optional charge control additives are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners).

Processes for the preparation of spherical toners at coalescence temperatures of from about 101 to about 120° C. are illustrated in U.S. Pat. No. 5,501,935, the disclosure of which is totally incorporated herein by reference.

The appropriate components and processes of the above copending patent application and Xerox patents may be selected for the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant, especially pigment dispersion, thus enabling the achievement of excellent color print quality.

In a further feature of the present invention there is provided a process for the preparation of toner compositions with a volume average diameter of from between about 1 to about 20 microns, and preferably from about 2 to about 12 microns, and a particle size distribution of about 1.10 to about 1.35, and preferably from about 1.15 to about 1.25 as measured by a Coulter Counter without the need to resort to conventional classifications to narrow the toner particle size distribution.

In a further feature of the present invention there is provided a process for the preparation of toner by aggregation and coalescence or fusion (aggregation/coalescence) of latex, colorant, and additive particles and wherein there is selected for the latex generation a reactive surfactant, such as a sulfonic acid, and wherein the latex is substantially sediment free and substantially microaggregate free.

Moreover, in a further feature of the present invention there is provided a process for the preparation of toner compositions which after fixing to paper substrates results in images with an image gloss of from about 20 GGU (Gardner Gloss Units) up to over 75 GGU as measured by Gardner Gloss meter, depending on the substrate and intended application.

In yet another feature of the present invention there are provided toner compositions with low fusing temperatures of from about 120° C. to about 180° C., and which toner compositions exhibit excellent blocking characteristics at and above about 45° C.

In a further feature of the present invention there are provided toner compositions which when fixed on paper, minimize objectionable image feel, and minimize or eliminate paper curl.

These and other features of the present invention are accomplished in embodiments by the provision of toners and processes thereof. In embodiments of the present invention, there are provided processes for the preparation of toner compositions by the aggregation/coalescence of latex and colorant, especially pigment particles, and wherein a reactive surfactant is selected for the generation of the latex, and wherein the temperature of aggregation may be selected to control the aggregate size, and thus the final toner particle size, and the coalescence temperature and time may be utilized to, for example, control the toner shape and surface properties.

In embodiments, the present invention is directed to a substantially sediment free, or coagulum free process comprised of blending an aqueous colorant, especially pigment dispersion containing an ionic surfactant with a latex emulsion comprised of polymer particles, preferably submicron in size of from, for example, about 0.05 micron to about 1 micron in volume average diameter, a sulfonic acid surfactant and an ionic surfactant of opposite charge polarity to that of the ionic surfactant in the colorant dispersion, heating the resulting flocculent mixture at, for example, below about, or equal to about the latex resin glass transition temperature, and more specifically, from about 35° C. to about 60° C. (Centigrade) to form toner sized aggregates of from about 2 microns to about 20 microns in volume average diameter, and which toner is comprised of polymer or resin, colorant, especially pigment, and optionally additive particles, followed by heating the aggregate suspension above about, or equal to about the resin glass transition temperature, and more specifically at, for example, from about 70° C. to about 100° C. to effect coalescence or fusion of the components of the aggregates and to form mechanically stable integral toner particles. Additionally, in embodiments there can be provided toner particles with spherical shape at lower coalescence temperatures and/or shorter coalescence times. Toners with a smoother surface, and in particular with a spherical shape, transfer efficiently from the photoreceptor surface to the substrate, thereby effectively preserving image integrity during the transfer step, affording higher image signal-to-noise ratios, and thus higher image quality. High toner transfer efficiency also reduces or eliminates toner waste and enables a substantially "cleaner-less" machine design in that the developed images are completely or virtually completely transferred to the substrate, leaving essentially no residual toners on the photoreceptor, and thus substantially no waste toner. A cleaner-less machine design also significantly prolongs the photoreceptor life since the mechanical abrasion wear of the photoreceptor due to cleaning is eliminated, thus enabling reduced machine maintenance service requirement and lowered hardware cost.

The particle size of the toner compositions provided by the processes of the present invention in embodiments can be preferably controlled by the temperature at which the aggregation of latex, colorant, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 12 percent by weight, an aggregate size of about 7 microns in volume average diameter is obtained at an aggregation temperature of about 53° C., the same latex will provide an aggregate size of about 5 microns at a temperature of about 48° C. under similar conditions. In embodiments of the present invention, an aggregate size stabilizer can be optionally added during the coalescence to minimize or prevent the aggregates from growing in size with increasing temperature, and which stabilizer is generally an ionic surfactant with a charge polarity opposite to that of the ionic surfactant in the colorant, especially pigment dispersion.

In embodiments thereof, the present invention relates to a direct toner preparative process comprised of blending an aqueous colorant dispersion containing, for example, a pigment, such as HELIOGEN BLUE™ or HOSTAPERM PINK™, and a cationic surfactant, such as benzalkonium chloride (SANIZOL B-50™), and a latex emulsion containing the reactive surfactant, such as for example 2-acrylamido-2-methylpropane sulfonic acid (AMPS), and the salts thereof, such as 2-acrylamido-2-methylpropane sulfonic acid ammonium salt, and wherein the latex polymer is derived from emulsion polymerization of monomers selected, for example, from the group consisting of styrene, acrylates, methacrylates, acrylonitrile, butadiene, acrylic acid, methacrylic acid, and the like, thereby resulting in the flocculation of the polymer particles with the pigment particles and optional additives; and which flocculent mixture, on further stirring at a temperature of from about 35° C. to about 60° C., results in the formation of toner sized aggregates with an aggregate size of from about 2 microns to about 10 microns in volume average diameter as measured by the Coulter Counter (Microsizer II) and a particle size distribution of about 1.15 to about 1.35; thereafter, heating the aggregate suspension at from about 70° C. to about 95° C. to form toner particles; followed by isolation, filtration, washing, and drying in an oven, or the like.

The present invention relates to processes for the preparation of toner comprising (i) aggregating a colorant and a latex emulsion containing a resin, reactive surfactant, and an ionic surfactant to form toner sized aggregates, (ii) coalescing or fusing said aggregates; and optionally (iii) isolating the toner generated, washing, and drying the toner; a process wherein said aggregating is below about the resin glass transition temperature present in the latex emulsion, the coalescing or fusing of said aggregates is above the resin glass transition temperature, and there results a toner with size of from about 2 to about 20 microns in volume average diameter, and wherein said toner is isolated, washed, and dried; a process wherein said temperature below the glass transition temperature is from about 25° C. to about 60° C., and the heating above the glass transition temperature is from about 60° C. to about 100° C.; a process wherein said temperature below the glass transition temperature is from about 45° C. to about 55° C., and the heating above the glass transition temperature is from about 80° C. to about 95° C.; a process wherein the temperature at which said aggregation is accomplished controls the size of the aggregates, and wherein the final toner size is from about 2 to about 10 microns in average volume diameter, and wherein the temperature and time of said coalescence or fusion of the components of aggregates control the shape of the resultant toner; a process wherein the aggregation temperature is from about 45° C. to about 55° C., and wherein the coalescence or fusion temperature of (ii) is from about 85° C. to about 95° C.; a process wherein the reactive surfactant is 2-acrylamido-2-methylpropane sulfonic acid or a salt thereof, ammonium 2-acrylamido-2-methylpropane sulfonate, 2-sulfoethyl methacrylate, sodium vinyl sulfonate, sodium styrene sulfonate, sodium alkyl allyl sulfosuccinate, sodium 1-allyloxy 2-hydroxy propane sulfonate, or mono- and diphosphated 2-hydroxyethyl methacrylate; a process wherein the reactive surfactant is 2-acrylamido-2-methylpropane sulfonic acid, or 2-arylamido-2-methylpropane sulfonic acid ammonium salt; a process wherein the surfactant is selected in an amount of from about 0.05 to about 10 weight percent based on the amount of monomers selected for the preparation of the resin latex; a process wherein reactive surfactant is selected in an amount of from about 0.1 to about 5 weight percent based on the amount of monomers selected for the preparation of the resin latex; a process wherein the colorant is a pigment and wherein said pigment in the form of a dispersion contains an ionic surfactant, and the latex emulsion contains said reactive surfactant and an ionic surfactant of opposite charge polarity to that of ionic surfactant present in said pigment dispersion, and wherein said toner is isolated, washed, and dried; a process wherein there is selected for the colorant in the form of a dispersion a cationic surfactant, and the ionic surfactant present in the latex mixture is an anionic surfactant; a process wherein the aggregating is conducted at a temperature about 15° C. to about 1° C. below the Tg of the latex resin for a duration of from about 0.5 hour to about 3 hours; a process wherein the coalescence or fusion of the components of aggregates for the formation of integral toner particles comprised of colorant and resin is accomplished at a temperature of about 85° C. to about 95° C. for a duration of from about 1 hour to about 5 hours; a process wherein the latex resin is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), and wherein said resin is optionally present in an effective amount of from 80 percent by weight to about 98 percent by weight of toner; a process wherein the latex resin is selected from the group consisting of poly(styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly (propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), wherein said toner is isolated, washed and dried; a process wherein the latex ionic surfactant is an anionic surfactant selected from the group consisting of sodium dodecyl sulfate, sodium dodecylbenzene sulfate and sodium dodecyinaphthalene sulfate, and. wherein the cationic surfactant is a quaternary ammonium salt; a process wherein the colorant is carbon black, magnetite, cyan, yellow, magenta, or mixtures thereof; a process wherein the toner particles are isolated and are from about 2 to about 10 microns in volume average diameter, and the particle size distribution thereof is from about 1.15 to about 1.30, wherein each of the surfactants utilized represents from about 0.01 to about 5 weight percent of the total reaction mixture, and wherein there is added to the surface of the formed toner metal salts, metal salts of fatty acids, silicas, metal oxides, or mixtures thereof, each in an amount of from about 0.1 to about 10 weight percent of the obtained toner particles; a substantially sediment free process for the preparation of toner comprising aggregating a colorant dispersion with a latex emulsion containing resin, and reactive surfactant; and coalescing said aggregates; a process wherein the toner is isolated, washed and dried; a process wherein the reactive surfactant is 2-acrylamido-2-methylpropane sulfonic acid; a process wherein the reactive surfactant is 2-acrylamido-2-methylpropane sulfonic acid ammonium salt; and a process for the preparation of toner comprising (i) aggregating a colorant dispersion containing a cationic surfactant and a latex emulsion containing resin, reactive surfactant, nonionic surfactant, and ionic surfactant of opposite charge to said cationic surfactant to form toner sized aggregates, (ii) coalescing said aggregates; cooling; and (iii) isolating the toner formed, followed by washing, and drying the toner.

In embodiments, the present invention is directed to processes for the preparation of toner compositions which comprises blending an aqueous colorant dispersion containing a colorant, such as carbon black, red, green, blue, brown, orange, phthalocyanine, quinacridone or RHODAMINE B™ type with a cationic surfactant, such as benzalkonium chloride, and a latex emulsion derived from emulsion polymerization of monomers selected from the group consisting of styrene, butadiene, acrylates, methacrylates, acrylonitrile, acrylic acid, methacrylic acid, and the like, chain transfer agent, and which latex contains an optional anionic surfactant, such as sodium dodecylbenzene sulfonate, and a reactive sulfonic acid surfactant, and which latex is of a size of, for example, from about 0.05 to about 1.0 micron; heating the resulting flocculent mixture at a temperature below or about equal to the Tg of the polymer or resin formed in the latex ranging, for example, from about 30° C. to about 55° C. for an effective length of time of, for example, 0.5 hour to about 2 hours to form toner sized aggregates; and subsequently heating the aggregate suspension at a temperature at or above the Tg of the latex polymer, for example from about 60° C. to about 100° C. to provide toner particles; and thereafter, isolating the toner product by filtration, washing and drying in an oven, fluid bed dryer, freeze dryer, or spray dryer; whereby toner particles comprised of polymer, or resin, colorant, and optional additives are obtained.

With the processes of the present invention, of importance is the selection of a reactive surfactant, such as an ethylenically unsaturated compound containing an ionizable acid functionality that is capable of undergoing addition polymerization. Preferred reactive surfactants include 2-acrylamido-2-methylpropane sulfonic acid (AMPS), ammonium 2-acrylamido-2-methylpropane sulfonate, sodium 2-acrylamido-2-methylpropane sulfonate, 2-sulfoethyl methacrylate, sodium vinyl sulfonate, sodium styrene sulfonate, sodium alkyl allyl sulfosuccinate, wherein alkyl is dodecyl (TERM LF-40™ available from Henkel), sodium 1-allyloxy 2-hydroxy propane sulfonate (Sipemer COPS I™ available from Rhone-Poulenc), mono- and diphosphated 2-hydroxyethyl methacrylate, and the like. A preferred reactive surfactant is 2-acrylamido-2-methylpropane sulfonic acid or its salts, such as 2-acrylamido-2-methylpropane sulfonic acid ammonium salt, available from Lubrizol Chemicals. The reactive surfactant can be selected in various suitable amounts, such as for example from about 0.05 to about 10, and preferably from about 0.1 to about 5 percent, or parts based on the monomer, or monomers used to prepare the latex polymer resin.

The use of a reactive surfactant in emulsion polymerizations in place of, for example, known surface agents provides a number of advantages. For example, the reactive surfactant is a surface active agent, the reactive surfactant contains a functional group or functional groups and a polymerizable double bond, thus it can copolymerize into the latex polymer matrix, preferably at the particle surface, thereby providing a source of fixed, or constant charge. Consequently, the physical properties of the latex are not considered alterable by an adsorption/desorption cycle as is the situation with traditional surfactants. With the present invention, copolymer latexes of styrene/butyl acrylate/acrylic acid with a reactive surfactant can be prepared with substantially less coagulum formation by means of charge repulsion and steric stabilization, and the resultant emulsion/aggregation toner latexes are sediment free, or substantially sediment free. Since there is desired a surface charge, and therefore toner charge stability, which is fixed and constant, a small amount, for example about 0.1 to about 1 percent or parts, based on the amount of monomer or monomers selected to prepare the latex, of reactive surfactant is usually selected to provide the same stability as an adsorbed surface active agent. In embodiments, the reactive surfactant can be used alone, or together with conventional anionic and/or nonionic surfactants to enable sediment-free toner latexes.

Embodiments of the present invention include a process for the preparation of toner comprised of polymer and colorant, especially pigment comprising (i) blending an aqueous pigment dispersion containing an ionic surfactant with a latex emulsion containing a reactive surfactant and an ionic surfactant with a charge polarity opposite to that of ionic surfactant in the pigment dispersion, and a water miscible chain transfer agent, or a transurf component with chain transfer characteristics;

(ii) heating the resulting mixture at a temperature of about 25° C. to about 1° C. below the Tg (glass transition temperature) of the latex polymer to form toner sized aggregates;

(iii) subsequently heating the aggregate suspension to a temperature of about 75° C. to about 110° C. to effect coalescence or fusion of the components of aggregates to enable formation of integral toner particles comprised of polymer, colorant, especially pigment, and optional additives; and (iv) isolating the toner product by, for example, filtration, followed by washing and drying.

The present invention relates to processes for the preparation of toner compositions which comprise (i) preparing an ionic colorant mixture by dispersing a colorant, especially pigment, such as carbon black, HOSTAPERM PINK™, or PV FAST BLUE™ in an aqueous surfactant solution containing a cationic surfactant, such as dialkylbenzene dialkylammonium chloride like SANIZOL B-50™ available from Kao, or MIRAPOL™ available from Alkaril Chemicals, by means of a high shearing device such as a Brinkmann Polytron or IKA homogenizer; (ii) adding the aforementioned colorant, especially pigment mixture, to a mixture of water, and a latex emulsion of polymer particles of, for example, poly(styrene-butyl acrylate-acrylic acid), poly(styrene-butadiene-acrylic acid), and the like, an anionic surfactant such as sodium dodecylsulfate, dodecylbenzene sulfonate or NEOGEN R™, and a nonionic surfactant such as polyethylene glycol or polyoxyethylene glycol nonyl phenyl ether or IGEPAL 897™ obtained from GAF Chemical Company, and a reactive surfactant, thereby causing a flocculation of pigment, and polymer particles; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymer to form toner sized aggregates of from about 2 microns to about 10 microns in volume average diameter; (iv) and heating the mixture in the presence of additional anionic surfactant or nonionic surfactant at a temperature of 95° C. or below for a duration of, for example, from about 1 to about 5 hours to form 2 to about 12 micron toner preferably with a particle size distribution of from about 1.15 to about 1.35 as measured by the Coulter Counter; and (v) isolating the toner particles by filtration; washing, and drying. Additives to improve flow characteristics and charge additives, if not initially present, to improve charging characteristics may be added by blending with the formed toner, such additives including AEROSILS® or silicas, metal oxides like tin, titanium and the like, metal salts of fatty acids like zinc stearate, and which additives are present in various effective amounts, such as from about 0.1 to about 10 percent by weight of the toner.

Illustrative examples of specific latex polymer or polymers selected for the process of the present invention include known polymers, such as poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), related terpolymers, and the like. The latex polymer is generally present in toner compositions of the present invention in various effective amounts, such as from about 75 weight percent to about 98 weight percent of the toner, and the latex size suitable for the processes of the present invention can be, for example, of from about 0.05 micron to about 1 micron in volume average diameter as measured by the Brookhaven nanosize particle analyzer. Other sizes and effective amounts of latex polymer may be selected in embodiments.

The polymer selected for the process of the present invention is preferably prepared by emulsion polymerization methods, and the monomers utilized in such processes include styrene, acrylates, methacrylates, butadiene, isoprene, acrylic acid, methacrylic acid, acrylonitrile, and the like. Known chain transfer agents, for example dodecanethiol, about 0.1 to about 10 percent, or carbon tetrabromide in effective amounts, such as from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants, such as pigments present in the toner in an effective amount of, for example, from about 1 to about 15 percent by weight of toner, and preferably in an amount of from about 3 to about 10 percent by weight, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Colorants include pigment, dye, mixtures of pigment and dyes, mixtures of pigments, mixtures of dyes, and the like.

The toner may also include known charge additives in effective suitable amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in effective amounts of, for example, 0.01 to about 15 weight percent of the reaction mixture in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ in effective amounts of, for example, from about 0.1 to about 10 percent by weight of the reaction mixture; anionic surfactants, such as for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like, in effective amounts of, for example, from about 0.01 to about 10 percent by weight; cationic surfactants, such as for example dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to about 4.

Examples of the surfactant, which are added to the aggregates before coalescence is initiated, can be selected from anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant utilized in the coalescence to stabilize the aggregate size against further growth with temperature is, for example, from about 0.01 to about 10 percent by weight, and preferably from about 0.5 to about 5 percent by weight of reaction mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carriers may also include other known carriers, such as a core with a polymethylmethacrylate with a dispersed conductive component therein, such as conductive carbon black.

Imaging methods are also envisioned with the toners of the present invention, reference for example a number of the patents mentioned herein, and U.S. Pat. Nos. 4,265,990; 4,585,884 and 4,563,408, the disclosures of which are totally incorporated herein by reference.

The following Examples are being provided to further define various pieces of the present invention. These Examples are intended to be illustrative only and are not intended to limit the scope of the present invention. A Comparative Example is also provided.

EXAMPLE I

A latex emulsion comprised of polymer particles derived from, or generated from the emulsion polymerization of styrene, butyl acrylate and acrylic acid was prepared as follows. 221.4 Grams of styrene, 48.6 grams of butyl acrylate, 5.4 grams of acrylic acid, 5.4 grams of 1-dodecanethiol and 2.7 grams of carbon tetrabromide were mixed with 391 grams of deionized water in which 19.2 grams of sodium dodecyl benzene sulfonate anionic surfactant, NEOGEN R™ (20 percent active), 5.8 grams of polyoxyethylene nonyl phenyl ether nonionic surfactant, ANTAROX CA 897™ (70 percent active), 2.7 grams of ammonium persulfate initiator, and 2.7 grams of AMPS 2411™ (2-acrylamido-2-methylpropane sulfonic ammonium salt, 50 percent active, available from Lubrizol) as the reactive surfactant were dissolved. The resulting mixture was stirred at room temperature of about 25° C. under a nitrogen atmosphere for 30 minutes. Subsequently, the resulting mixture was stirred and heated to 70° C. (Centigrade throughout) at a rate of 1° C. per minute, and retained at this temperature for 6 hours. The resulting latex polymer possessed an $M_w$ of 34,400, an $M_n$ of 6,800 as determined on a Waters GPC, and a mid-point Tg of 57.9° C. as measured on a Seiko DSC. The latex polymer, or latex resin possessed an volume average diameter for the polymer of 183 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was less than 0.1 weight percent of the latex after two weeks.

260.0 Grams of the above prepared latex emulsion and 220.0 grams of an aqueous cyan pigment dispersion containing 7.6 grams of Cyan Pigment 15:3, and 2.6 grams of cationic surfactant SANIZOL B-50™ were simultaneously added to 400 milliliters of water with high stirring at 6,000 rpm for 3 minutes by means of a polytron. The resulting mixture was then transferred to a 2 liter reaction vessel and heated at a temperature of 53° C. for 2.0 hours before 30 milliliters of 20 percent aqueous NEOGEN R™ solution were added. Aggregates with a particle size (volume average diameter) of about 8.4 microns with a GSD=1.20, as measured on the Coulter Counter, were obtained. Subsequently, the mixture was heated to 92° C. and held there for a period of 3 hours before cooling down to room temperature, about 25° C. throughout, filtered, washed with water a number of times, and dried in a freeze dryer. The final toner product evidenced a particle size of 8.6 microns in volume average diameter with a particle size distribution of 1.19 as measured on a Coulter Counter.

The resulting toner, that is the above final toner product, was comprised of about 93 percent of polymer, poly (styrene-butyl acrylate-acrylic acid), and 15:3 Cyan Pigment, about 7 percent by weight of toner, with a toner volume average diameter of 8.6 microns and a GSD of 1.19, indicating that one can retain toner particle size and GSD achieved in the aggregation during coalescence, without the aggregates falling apart, or separating and without an excessive increase in particle size, when a sediment free polymer emulsion was prepared by adding a reactive surfactant of ammonium 2-acrylamido-2-methylpropane sulfonic ammonium salt to, for example, enhance the latex stability.

EXAMPLE II

A latex emulsion comprised of polymer particles derived from the emulsion polymerization of styrene, butyl acrylate and acrylic acid was prepared as follows. 442.8 Grams of styrene, 97.2 grams of butyl acrylate, 10.8 grams of acrylic acid, 14.9 grams of 1-dodecanethiol and 5.4 grams of carbon tetrabromide were mixed with 782 grams of deionized water in which 11.6 grams of polyoxyethylene nonyl phenyl ether nonionic surfactant, ANTAROX CA 897™(70 percent active), 5.4 grams of ammonium persulfate initiator, and 5.4 grams of the reactive surfactant of Example I, AMPS 2411™ were dissolved. No anionic surfactants, for example sodium dodecyl benzene sulfonate, were utilized in this Example. The resulting mixture was stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 22,500, an $M_n$ of 4,700 as determined on a Waters GPC, and a mid-point Tg of 54.9° C. as measured on a Seiko DSC. The latex polymer, or latex resin possessed an average volume diameter for the polymer of 223 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was less than 0.1 weight percent of the latex after two weeks.

260.0 Grams of the above prepared latex emulsion and 220.0 grams of an aqueous cyan pigment dispersion containing 7.6 grams of Cyan Pigment 15:3, and 2.6 grams of cationic surfactant SANIZOL B-50™ were simultaneously added to 400 milliliters of water with high stirring at 6,000 rpm for 3 minutes by means of a polytron. The resulting mixture was then transferred to a 2 liter reaction vessel and heated at a temperature of 50° C. for 2.0 hours before 30 milliliters of 20 percent aqueous NEOGEN R™ solution was added. Aggregates with a particle size (volume average diameter) of about 6.2 microns with a GSD=1.23, as measured on the Coulter Counter, were obtained. Subsequently, the mixture was heated to 93° C. and held there for a period of 3 hours before cooling down to room temperature, about 25° C. throughout, filtered, washed with water a number of times, and dried in a freeze dryer. The final toner product evidenced a particle size of 6.4 microns in volume average diameter with a particle size distribution of 1.22 as measured on a Coulter Counter.

The resulting toner, that is the above final toner product, was comprised of about 93 percent of polymer, poly (styrene-butyl acrylate-acrylic acid), and 15:3 Cyan Pigment, about 7 percent by weight of toner with a volume average diameter of 6.4 microns and a GSD of 1.22, indicating that one can retain toner particle size and GSD achieved in the aggregation step during coalescence without the aggregates falling apart, or separating and without an excessive increase in particle size, when a sediment free polymer emulsion was prepared by adding the reactive to, for example, enhance the latex stability.

EXAMPLE III

A latex emulsion comprised of polymer particles derived from the emulsion polymerization of styrene, butyl acrylate and acrylic acid was prepared as follows. 442.8 Grams of styrene, 96.2 grams of butyl acrylate, 10.8 grams of acrylic acid, 14.9 grams of 1-dodecanethiol, and 5.4 grams of carbon tetrabromide were mixed with 782 grams of deionized water in which 38.3 grams of sodium dodecyl benzene sulfonate anionic surfactant, NEOGEN R™ (20 percent active), 11.6 grams of polyoxyethylene nonyl phenyl ether nonionic surfactant, ANTAROX CA 897™ (70 percent active), 5.4 grams of ammonium persulfate initiator, and 2.7 grams of AMPS 2404™ (2-acrylamido-2-methylpropane sulfonic acid, 99 percent active, available from Lubrizol) as the reactive surfactant were dissolved. The resulting mixture was stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 39,200, an $M_n$ of 5,100 as determined on a Waters GPC, and a mid-point Tg of 52.9° C. as measured on a Seiko DSC. The latex polymer, or latex resin possessed a volume average diameter for the polymer of 173 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was less than 0.1 weight percent of the latex after two weeks.

260.0 Grams of the above prepared latex emulsion and 220.0 grams of an aqueous cyan pigment dispersion containing 7.6 grams of Cyan Pigment 15:3, and 2.6 grams of cationic surfactant SANIZOL B-50™ were simultaneously added to 400 milliliters of water with high stirring at 6,000 rpm for 3 minutes by means of a polytron. The resulting mixture was then transferred to a 2 liter reaction vessel and heated at a temperature of 48° C. for 2.0 hours before 30 milliliters of 20 percent aqueous NEOGEN R™ solution was added. Aggregates with a particle size (volume average diameter) of about 5.8 microns with a GSD=1.23, as measured on the Coulter Counter, were obtained. Subsequently, the mixture was heated to 92° C. and held there for a period of 3 hours before cooling down to room temperature, about 25° C. throughout, filtered, washed with water a number of times, and dried in a freeze dryer. The final toner product evidenced a particle size of 5.9 microns in volume average diameter with a particle size distribution of 1.24 as measured on a Coulter Counter.

The resulting toner, that is the above final toner product, was comprised of about 93 percent of polymer, poly (styrene-butyl acrylate-acrylic acid), and 15:3 Cyan Pigment, about 7 percent by weight of toner, with a toner volume average diameter of 5.9 microns and a GSD of 1.24, indicating that one can retain toner particle size and GSD achieved in the aggregation step during coalescence without the aggregates falling apart, or separating and without an excessive increase in particle size, when a sediment free polymer emulsion was prepared by adding a reactive surfactant of 2-acrylamido-2-methylpropane sulfonic acid to primarily enhance the latex stability.

EXAMPLE IV

A latex emulsion comprised of polymer particles derived from the emulsion polymerization of styrene, butyl acrylate and acrylic acid was prepared as follows. 442.8 Grams of styrene, 96.2 grams of butyl acrylate, 10.8 grams of acrylic acid, 14.9 grams of 1-dodecanethiol and 5.4 grams of carbon tetrabromide were mixed with 782 grams of deionized water in which 38.3 grams of sodium dodecyl benzene sulfonate anionic surfactant, NEOGEN RT™ (20 percent active), 11.6 grams of polyoxyethylene nonyl phenyl ether nonionic surfactant, ANTAROX CA 897™ (70 percent active), 5.4 grams of ammonium persulfate initiator, and 5.4 grams of AMPS 2405™ (2-acrylamido-2-methylpropane sulfonic acid sodium salt, 50 percent active, available from Lubrizol) as the reactive surfactant were dissolved. The resulting mixture was stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$, of 21,800, an $M_n$ of 5,600 as determined on a Waters GPC, and a mid-point Tg of 59.8° C. as measured on a Seiko DSC. The latex polymer, or latex resin possessed an average volume diameter for the polymer of 168 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was less than 0.1 weight percent of the latex after two weeks. 260.0 Grams of the above prepared latex emulsion and 220.0 grams of an aqueous cyan pigment dispersion containing 7.6 grams of Cyan Pigment 15:3, and 2.6 grams of cationic surfactant SANIZOL B-50™ were simultaneously added to 400 milliliters of water with high stirring at 6,000 rpm for 3 minutes by means of a polytron. The resulting mixture was then transferred to a 2 liter reaction vessel and heated at a temperature of 53° C. for 2.0 hours before 30 milliliters of 20 percent aqueous NEOGEN R™ solution were added. Aggregates with a particle size (volume average diameter) of about 6.5 microns with a GSD=1.23, as measured on the Coulter Counter, were obtained. Subsequently, the mixture was heated to 93° C. and held there for a period of 3 hours before cooling down to room temperature, about 25° C. throughout, filtered, washed with water a number of times, and dried in a freeze dryer. The final toner product evidenced a particle size of 6.9 microns in volume average diameter with a particle size distribution of 1.26 as measured on a Coulter Counter.

The resulting toner, that is the above final toner product, was comprised of about 93 percent of polymer, poly (styrene-butyl acrylate-acrylic acid), and 15:3 Cyan Pigment, about 7 percent by weight of toner, with a volume average diameter of 6.9 microns and a GSD of 1.26, indicating that one can retain toner particle size and GSD achieved in the aggregation step during coalescence without the aggregates falling apart, or separating and without an excessive increase in particle size, when a sediment free polymer emulsion was prepared by adding a reactive surfactant of sodium 2-acrylamido-2-methylpropane sulfonate sodium salt to, for example, enhance the latex stability.

EXAMPLE V

A latex emulsion comprised of polymer particles derived from the emulsion polymerization of styrene, butyl acrylate and acrylic acid was prepared as follows. 442.8 Grams of styrene, 96.2 grams of butyl acrylate, 5.4 grams of acrylic acid, 14.9 grams of 1-dodecanethiol and 5.4 grams of carbon tetrabromide were mixed with 782 grams of deionized water in which 38.3 grams of sodium dodecyl benzene sulfonate anionic surfactant, NEOGEN R™ (20 percent active), 11.6 grams of polyoxyethylene nonyl phenyl ether nonionic surfactant, ANTAROX CA 897™ (70 percent active), 5.4 grams of ammonium persulfate initiator, and 16.2 grams of sodium vinyl sulfonate (25 percent active, available from Air Products) as the reactive surfactant were dissolved. The resulting mixture was stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 39,000, an $M_n$ of 5,900 as determined on a Waters GPC, and a mid-point Tg of 48.0° C. as measured on a Seiko DSC. The latex polymer, or latex resin possessed a volume average diameter for the polymer of 160 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was less than 0.1 weight percent of the latex after two weeks.

260.0 Grams of the above prepared latex emulsion and 220.0 grams of an aqueous cyan pigment dispersion containing 7.6 grams of Cyan Pigment 15:3, and 2.6 grams of cationic surfactant SANIZOL B-50™ were simultaneously added to 400 milliliters of water with high stirring at 6,000 rpm for 3 minutes by means of a polytron. The resulting mixture was then transferred to a 2 liter reaction vessel and heated at a temperature of 44° C. for 2.0 hours before 30 milliliters of 20 percent aqueous NEOGEN RT™ solution were added. Aggregates with a particle size (volume average diameter) of about 7.0 microns with a GSD=1.19, as measured on the Coulter Counter, were obtained. Subsequently, the mixture was heated to 92° C. and held there for a period of 3 hours before cooling down to room temperature, about 25° C. throughout, filtered, washed with water a number of times, and dried in a freeze dryer. The final toner product evidenced a particle size of 7.5 microns in volume average diameter with a particle size distribution of 1.24 as measured on a Coulter Counter.

The resulting toner, that is the above final toner product, was comprised of about 93 percent of polymer, poly (styrene-butyl acrylate-acrylic acid), and 15:3 Cyan Pigment, about 7 percent by weight of toner, with an volume average diameter of 7.5 microns and a GSD of 1.24, indicating that one can retain toner particle size and GSD achieved in the aggregation step during coalescence without the aggregates falling apart, or separating and without an excessive increase in particle size, when a sediment free polymer emulsion was prepared by adding a reactive surfactant of sodium vinyl sulfonate to, for example, enhance the latex stability.

EXAMPLE VI

A latex emulsion comprised of polymer particles derived from the emulsion polymerization of styrene, butyl acrylate and acrylic acid was prepared as follows. 442.8 Grams of styrene, 96.2 grams of butyl acrylate, 10.8 grams of acrylic acid, 16.2 grams of 1-dodecanethiol and 5.4 grams of carbon tetrabromide were mixed with 782 grams of deionized water in which 38.3 grams of sodium dodecyl benzene sulfonate anionic surfactant, NEOGEN R™ (20 percent active), 11.6 grams of polyoxyethylene nonyl phenyl ether nonionic surfactant, ANTAROX CA 897™ (70 percent active), 5.4 grams of ammonium persulfate initiator, and 11.3 grams of TREM LF-40™ (sodium dodecyl allyl sulfosuccinate, 36 percent active, available from Henkel) as the reactive surfactant were dissolved. The resulting mixture was stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$, of 27,000, an $M_n$ of 4,800 as determined on a Waters GPC, and a mid-point Tg of 52.8° C. as measured on a Seiko DSC. The latex polymer, or latex resin possessed an average volume diameter for the polymer of 163 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was less than 0.1 weight percent of the latex after two weeks.

260.0 Grams of the above prepared latex emulsion and 220.0 grams of an aqueous cyan pigment dispersion containing 7.6 grams of Cyan Pigment 15:3, and 2.6 grams of cationic surfactant SANIZOL B-50™ were simultaneously added to 400 milliliters of water with high stirring at 6,000 rpm for 3 minutes by means of a polytron. The resulting mixture was then transferred to a 2 liter reaction vessel and heated at a temperature of 48° C. for 2.0 hours before 30 milliliters of 20 percent aqueous NEOGEN R™ solution were added. Aggregates with a particle size (volume average diameter) of about 7.8 microns with a GSD=1.19, as measured on the Coulter Counter, were obtained. Subsequently, the mixture was heated to 92° C. and held there for a period of 3 hours before cooling down to room temperature, about 25° C. throughout, filtered, washed with water a number of times, and dried in a freeze dryer. The final toner product evidenced a particle size of 8.1 microns in volume average diameter with a particle size distribution of 1.18 as measured on a Coulter Counter.

The resulting toner, that is the above final toner product, was comprised of about 93 percent of polymer, poly (styrene-butyl acrylate-acrylic acid), and 15:3 Cyan Pigment, about 7 percent by weight of toner, with a volume average diameter of 8.1 microns and a GSD of 1.18, indicating that one can retain toner particle size and GSD achieved in the aggregation step during coalescence without the aggregates falling apart, or separating and without an excessive increase in particle size, when a sediment free polymer emulsion was prepared by adding a reactive surfactant of sodium dodecyl allyl sulfosuccinate to, for example, enhance the latex stability.

COMPARATIVE EXAMPLE IA

A latex emulsion comprised of polymer particles derived from emulsion polymerization of styrene, butyl acrylate and acrylic acid was prepared as follows. 221.4 Grams of styrene, 48.6 grams of butyl acrylate, 5.4 grams of acrylic acid, 6.8 grams of 1-dodecanethiol, and 2.7 grams of carbon tetrabromide were mixed with 391 grams of deionized water in which 19.2 grams of sodium dodecyl benzene sulfonate anionic surfactant, NEOGEN R™ (20 percent active), 2.0 grams of polyoxyethylene nonyl phenyl ether nonionic surfactant, ANTAROX CA 897™ (70 percent active), and 2.7 grams of ammonium persulfate initiator were dissolved. Subsequently, the mixture was stirred and heated to 70° C. (Centigrade throughout) at a rate of 1° C. per minute, and retained at this temperature for 6 hours. The resulting latex polymer possessed an $M_w$ of 29,000, an $M_n$ of 5,100, as determined on a Waters GPC, and a mid-point Tg of 56.0° C., as measured on a Seiko DSC. The latex evidenced a volume average diameter for the polymer of 229 nanometers as measured by light scattering technique on a Coulter N4 Plus Particle Sizer.

Sediment containing low $M_w$ and low Tg polymer particles was observed after the latex was allowed to stand for two days. The amount of sediment determined via an IEC Centrifuge at 3,120 G-force for 50 seconds was about 5.8 weight percent of the prepared latex, which sediment contained undesirable polymer particles with low $M_w$=18,500 and a low glass transition temperature of 32° C. This undesirable portion of the latex can be removed from the remainder of the latex by a known sedimentation technique, and the amount of this undesirable latex was significantly reduced by the invention emulsion polymerization processes utilizing a reactive surfactant. A sediment is a latex containing undesirable polymer particles which possess a large particle size, low molecular weight and low Tg. An emulsion product containing some sediment is not as suitable both for the aggregation/coalescence processes and for generating toner compositions. A sediment can cause the aggregates to have a greater propensity to fall apart or an excessive increase in particle size, as evidenced by the final toner particle size and GSD. Therefore, the sediment is usually removed prior to the aggregation/coalescence to retain toner particle size with a narrow GSD. Sediment generated during the emulsion polymerization will result in loss of material, lower production yield, waste disposal, and a need for additional capital investment for sediment removal equipment such as a centrifuge.

In this Comparative Example, the undesirable polymer particles were not removed in order to be able to better compare the results of this Comparative Example with Examples I to VI. 260.0 Grams of the above prepared latex emulsion and 220.0 grams of an aqueous cyan pigment dispersion containing 7.6 grams of Cyan Pigment 15:3, and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 53° C. for 2.5 hours before 40 milliliters of 20 percent aqueous NEOGEN R™ solution were added. Aggregates with a particle size (volume average diameter) of 6.3 microns with a GSD=1.22, as measured on the Coulter Counter, were obtained. Subsequently, the mixture was heated to 90° C. and held there for a period of 3 hours before cooling down to room temperature, about 25° C. throughout, filtered, washed with water, and dried in a freeze dryer. The final toner product evidenced a particle size of 7.5 microns in volume average diameter with a particle size distribution of 1.35 as measured on a Coulter Counter.

The results in Examples I to VI indicate that the reactive surfactants, such as AMPS, enhanced the latex stability observed during emulsion polymerization and minimizes/eliminates the amount of sediment, the undesirable polymer particles, prepared during emulsion polymerization. An emulsion product containing sediment having undesirable properties is not as suitable both for aggregation/coalescence processes and for generating a toner composition. Sediment in an emulsion causes the aggregates to fall apart or grow substantially as demonstrated by this Comparative Example. As demonstrated by the above Examples I to VI, the use of the emulsion polymerization with a reactive surfactant can increase the latex stability and can yield latexes with desirable characteristics with respect to their use in aggregation processes.

Other modifications of the present invention will occur to those of ordinary skill in the art subsequent to a review of the present application. These modifications and equivalents, or substantial equivalents thereof are intended to be included within the scope of the present invention.

What is claimed is:

1. A process of the preparation of toner comprising (i) aggregating a colorant and a latex emulsion generated from polymerization of monomer and reactive surfactant in the presence of an ionic surfactant to form aggregates, (ii) coalescing or fusing said aggregates; and (iii) isolating the toner generated, washing, and drying the toner, wherein said reactive surfactant is addition polymerizable and ethylenically unsaturated, wherein said aggregating is below the resin glass transition temperature present in the latex emulsion, the coalescing or fusing of said aggregates is above the resin glass transition temperature, and there results a toner with size of from about 2 to about 20 microns in volume average diameter, and wherein the reactive surfactant is selected in an amount of from about 0.05 to about 10 weight percent based on the amount of said monomer.

2. A process in accordance with claim 1 wherein said temperature below the glass transition temperature is from about 25° C. to about 60° C., and the temperature above the glass transition temperature is from about 60° C. to about 100° C.

3. A process in accordance with claim 1 wherein said temperature below the glass transition temperature is from about 45° C. to about 55° C., and the temperature above the glass transition temperature is from about 80° C. to about 95° C.

4. A process in accordance with claim 1 wherein the aggregation temperature is from about 45° C. to about 55° C., and wherein the coalescence or fusion temperature of (ii) is from about 85° C. to about 95° C.

5. A process in accordance with claim 1 wherein the reactive surfactant is 2-acrylamido-2-methylpropane sulfonic acid or a salt thereof, ammonium 2-acrylamido-2-methylpropane sulfonate, 2-sulfoethyl methacrylate, sodium vinyl sulfonate, sodium styrene sulfonate, sodium alkyl allyl sulfosuccinate, or sodium 1-allyloxy 2-hydroxy propane sulfonate.

6. A process in accordance with claim 1 wherein the reactive surfactant is 2-acrylamido-2-methylpropane sulfonic acid, or 2-arylamido-2-methylpropane sulfonic acid ammonium salt.

7. A process in accordance with claim 1 wherein said reactive surfactant is selected in an amount of from about 0.1 to about 5 weight percent based on the amount of the monomer.

8. A process in accordance with claim 1 wherein the colorant is a pigment and wherein said pigment in the form of a dispersion contains an ionic surfactant, and the latex emulsion contains an ionic surfactant of opposite charge polarity to that of ionic surfactant present in said pigment dispersion, and wherein said toner is isolated, washed, and dried after cooling.

9. A process in accordance with claim 8 wherein there is selected for the colorant in the form of a dispersion a cationic surfactant, and an ionic surfactant is present in the latex mixture, and which ionic surfactant is an anionic surfactant.

10. A process in accordance with claim 9 wherein the latex ionic surfactant is selected from the group consisting of sodium dodecyl sulfate, sodium dodecylbenzene sulfate and sodium dodecylnaphthalene sulfate, and wherein the cationic surfactant is a quaternary ammonium salt.

11. A process in accordance with claim 1 wherein the aggregating is conducted at a temperature about 15° C. to about 1° C. below the Tg of the latex resin for a duration of from about 0.5 hour to about 3 hours.

12. A process in accordance with claim 1 wherein the coalescence or fusion of the components of aggregates for the formation of integral toner particles comprised of colorant and resin is accomplished at a temperature of about 85° C. to about 95° C. for a duration of from about 1 hour to about 5 hours.

13. A process in accordance with claim 1 wherein the colorant is carbon black, magnetite, cyan, yellow, magenta, or mixtures thereof.

14. A process in accordance with claim 1 wherein the toner particles are isolated and are from about 2 to about 10 microns in volume average diameter, and the GSD thereof is from about 1.15 to about 1.30, wherein for the latex and colorant dispersion there are included surfactants, and wherein each of the surfactants utilized represents from about 0.01 to about 5 weight percent of the total reaction mixture, and wherein there is added to the surface of the formed toner metal salts, metal salts of fatty acids, silicas, metal oxides, or mixtures thereof, each in an amount of from about 0.1 to about 10 weight percent of the obtained toner particles.

15. A process in accordance with claim 1 wherein said reactive surfactant is a mono phosphonated 2-hydroxyethyl methacrylate or a diphosphonated 2-hydroxyethyl methacrylate.

16. A process in accordance with claim 1 wherein the monomer is selected from the group consisting of styrene, butadiene, acrylates, methacrylates, acrylonitrile, acrylic acid, and methacrylic acid.

* * * * *